US010500597B2

(12) United States Patent
Wu et al.

(10) Patent No.: US 10,500,597 B2
(45) **Date of Patent: *Dec. 10, 2019**

(54) CONCEALED FLOW REGULATOR

(71) Applicants: XIAMEN SOLEX HIGH-TECH INDUSTRIES CO., LTD., Xiamen, Fujian (CN); Huasong Zhou, Fujian (CN)

(72) Inventors: Shilong Wu, Fujian (CN); Guosong Zhao, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 155 days.

This patent is subject to a terminal disclaimer.

(21) Appl. No.: 15/288,547

(22) Filed: Oct. 7, 2016

(65) Prior Publication Data

US 2017/0136476 A1 May 18, 2017

(30) Foreign Application Priority Data

Nov. 13, 2015 (CN) ..... 2015 1 0776609

(51) Int. Cl.
*B05B 7/04* (2006.01)
*B05B 15/40* (2018.01)
(Continued)

(52) U.S. Cl.
CPC ..... *B05B 7/0425* (2013.01); *B05B 1/18* (2013.01); *B05B 1/22* (2013.01); *B05B 15/40* (2018.02);
(Continued)

(58) Field of Classification Search
CPC . E03C 1/08; E03C 1/084; E03C 1/086; E03C 2001/082; E03C 2001/026;
(Continued)

(56) References Cited

U.S. PATENT DOCUMENTS 5,769,326 A * 6/1998 Muchenberger ..... E03C 1/08 239/428.5
2012/0325933 A1* 12/2012 Blum ..... E03C 1/08 239/428.5
(Continued)

FOREIGN PATENT DOCUMENTS

CN 202139650 U 2/2012
CN 202298777 U 7/2012

*Primary Examiner* — Cody J Lieuwen
(74) *Attorney, Agent, or Firm* — Rabin & Berdo, P.C.

(57) ABSTRACT

A concealed flow regulator includes a water supply opening providing a water flow and disposed with threads; a housing portion connected to the water supply opening and forming an air flow clearance therewith that communicates with exterior air, having an external revolution surface disposed with external threads and in which is defined a mutation cavity and a suction passage in communication with the mutation chamber and having an external port disposed in the external revolution surface in communication with the air flow clearance and an internal port that connects an interior portion of the mutation cavity with the exterior air; and a diversion device assembled within the housing portion through which the water flow flows into the mutation chamber and generates a negative pressure which sucks in exterior air via the air flow clearance and the suction passage that mixes with the divided water flow to produce bubble water.

14 Claims, 5 Drawing Sheets

(51) Int. Cl.

| | |
|---|---|
| ***B05B 1/18*** | (2006.01) |
| ***B05B 1/22*** | (2006.01) |
| ***E03C 1/084*** | (2006.01) |
| *E03C 1/02* | (2006.01) |

(52) U.S. Cl.
CPC ..... *E03C 1/084* (2013.01); *E03C 2001/026* (2013.01)

(58) Field of Classification Search
CPC ..... B05B 1/18; B05B 1/3006; B05B 7/005–0068; B05B 7/0425; B05B 15/40; B05B 15/008; B05B 1/22
USPC ..... 239/428.5, 462, 533.1, 590–590.5
See application file for complete search history.

(56) References Cited

U.S. PATENT DOCUMENTS

| | | | | |
|---|---|---|---|---|
| 2013/0068860 | A1* | 3/2013 | Tempel | B05B 1/3033 239/428.5 |
| 2013/0082121 | A1* | 4/2013 | Stein | E03C 1/08 239/428.5 |
| 2014/0145014 | A1* | 5/2014 | Blum | E03C 1/084 239/428.5 |
| 2016/0002897 | A1* | 1/2016 | Tempel | E03C 1/084 239/428.5 |

* cited by examiner

CONCEALED FLOW REGULATOR

FIELD OF THE INVENTION

The present invention relates to a concealed flow regulator.

BACKGROUND OF THE INVENTION

A setting-in element of sanitary ware is disclosed in Chinese patent database with announcement number CN202298777U, CN202139650U, the setting-in element has a housing, the housing is disposed with thread and a housing side with outlet side of flowing hole, at least an insert element is provided to assembled to the housing. The setting-in element is disposed with a flow regulator of ventilation, the periphery wall of the housing defines at least a ventilation passage at a part area of the double-wall structure formed, the housing side of the ventilation passage which face the outlet side is open and is connected to a ventilation opening leading to the inside of the housing. The sealing portion is disposed at the upper end of the inner side of the housing, it can only realize axial sealing, but can not achieve peripheral sealing.

SUMMARY OF THE INVENTION

The present invention is provided with a concealed flow regulator, which overcomes the disadvantages of the existing known technology.

The technical proposal of the present invention is that:

A concealed flow regulator, comprising a housing portion (100) and a diversion device (200) assembled in the housing portion (100), the housing portion (100) is disposed with a mutation cavity (110) and a suction passage (120) connecting the inner and the outer of the mutation cavity (110), the diversion device (200) is used to divide the water, negative pressure generates when the divided water flows into the mutation cavity (110), the air is sucked to mix with water to produce bubble water under the action of the negative pressure; the external revolution surface of the housing portion (100) is disposed with external thread (150), the housing portion (100) can be threaded to the water supplying opening (700) via the external thread (150); wherein the suction passage (120) is disposed with an internal port (121) faced to the mutation cavity (110) and an external port (122) disposed in the external revolution surface, an air flowing clearance is formed between the housing portion (100) and the inner wall of the water supplying opening (700), the air flowing clearance is connected to the external port, so that air can enter the mutation cavity (110) through the air flowing clearance, the external port and the internal port.

In another preferred embodiment, the external revolution surface of the housing portion (100) comprises an external smooth surface below the external thread (150), the external diameter of the external smooth surface is smaller than the external diameter of the external thread (150), the external port of the suction passage (120) is located on the external smooth surface, the external smooth surface and the internal wall of the water supply opening (700) are annularly arranged with space, the annular space forms above mentioned air flowing clearance.

In another preferred embodiment, the housing portion (100) comprises a housing (130) and a fixed ring (140), the housing (130) has an outer wall (131), the fixed ring (140) is fixedly connected to the upper portion of the outer wall (131); the outer wall (131) has a step structure having a wider end at a lower portion of the outer wall, i.e., with big end down, the step structure has a step surface (131*a*), the internal port (121) is located on the step surface.

In another preferred embodiment, the water supplying opening (700) is disposed with a step face (710) and an internal revolution surface extending outwardly from the external periphery of the step face, the internal revolution surface is disposed with internal thread, the lower portion of the internal revolution surface is an internal smooth surface; the external thread of the housing portion (100) is threaded to the internal thread, the internal smooth surface and the external smooth surface are arranged with space.

In another preferred embodiment, the flow regulator further comprises a sealing portion (600) having a surrounding portion (610) and a capping portion (620) extending inwardly from the internal periphery of the surrounding portion (610); the housing portion (100) comprises a housing (130) and a fixed ring (140), the housing (130) comprises an outer wall (131), the fixed ring (140) is fixedly connected to the upper portion of the outer wall (131), the fixed ring (140) is disposed with an annular protrusion (142) protruding outwardly radically, the annular protrusion (142) is supported on the upper end face of the housing (130), the fixed ring (140) has an assembly portion (143) located on the annular protrusion (142), the surrounding portion (610) is surrounded and fixedly sleeved on the outer side of the assembly portion (143), the capping portion (620) is at least capping the end face of the upper end portion of the assembly portion (143).

In another preferred embodiment, the assembly portion (143) is concaved with an annular groove (144), the bottom portion of the surrounding portion (610) is protruding inwardly with a protruding portion (611), the protruding portion (611) is fitly connected in the annular groove (144).

In another preferred embodiment, the bottom portion of the surrounding portion (610) is supported on the annular surface of the annular protrusion (142), the surrounding portion (610) is pressed and deformed to extend out of the annular protrusion to achieve peripheral sealing.

In another preferred embodiment, the flow regulator further comprises an annular seat (300) and an elastic water stop ring (400), the annular seat (300), the water diversion device (200) and the housing portion (100) are assembled together; the diversion device (200) comprises a periphery wall (210), a central base (220) in the periphery wall (210) and a deflecting annular wall (230) fixedly connecting the periphery wall (210) and the central base (220), the periphery wall (210) is disposed with diversion holes (211), the external periphery surface of the deflecting annular wall (230) is gradually larger downwardly radically from the central base (220) to the periphery wall (210), the central base (220) has at least a part extending out of the internal hole of the annular seat (300), a flowing clearance is formed between the central base (220) and the hole wall of the internal hole of the annular seat, the flowing clearance is disposed above the deflecting annular wall (230) to make water directly flow to the deflecting annular wall (230) through the flowing clearance; the water stop ring (400) is supported on the annular seat (300) to surround and fit to the central base (220), so that the flowing area of the flowing clearance is adjustable by the water pressure so as to save water.

In another preferred embodiment, the annular seat (300) is fixedly connected to the periphery wall (210); a protruding wall (310) is protruded on the annular seat (300) to surround the internal hole of the annular seat (300), the external side of the water stop ring is contacted with the internal side of the protruding wall (310).

In another preferred embodiment, a filter (500) is further provided, the filter (500) is assembled to the protruding wall (310).

In another preferred embodiment, the upper periphery of the periphery wall (210) protrudes outwardly with a support plate (212), the external periphery of the support plate (212) protrudes upwardly to form a connecting wall (213), the annular seat (300) is supported on the support plate (212), the annular seat (300) is fixedly connected the diversion device (200) by the cooperation of the connecting wall (213) and the annular seat (300).

In another preferred embodiment, the fixed ring (140) is disposed with a conical surface (141) corresponding to the diversion holes (211), the conical surface (141) surrounds the diversion device (200), so that water flows out of the diversion holes (211) and impacts the conical surface.

In another preferred embodiment, the external revolution surface of the deflecting annular wall (230) comprises a part of the conical surface.

In another preferred embodiment, the external revolution surface of the deflecting annular wall (230) comprises a smooth curve.

In another preferred embodiment, the external revolution surface of the deflecting annular wall (230) comprises an arc with the center of circle outward.

Compared to the existing known technology, the technical proposal of the present invention has advantages as follows:

1. the external port of the suction passage is disposed on the external revolution surface of the housing, the air flowing clearance is formed between the housing portion and the inner wall of the water supplying opening, the air flowing clearance is connected to the external port, so that air at the outer side can enter the mutation cavity through the air flowing clearance, the external port and the internal port, on one hand, the air is sucked through the housing portion and the water supplying opening, the air inlet is disposed between the housing portion and the water supplying opening, so that the flow regulator can be assembled in the water supplying opening and be concealed, on the other hand, it sucks high volume of air, the structure is compact and the manufacturing cost is low.
2. the external wall is a step structure of big end down, the internal port is disposed on the step surface of the step structure, the air and the water are mixed well.
3. the external thread of the housing portion is thread to the internal thread, the internal smooth surface and the external smooth surface are arranged with space so as to ensure the connecting of the suction passage.
4. the sealing portion has a surrounding portion and a capping portion, the surrounding portion can obtain the peripheral sealing, the capping portion can obtain the axial sealing, so that it has well sealing performance, the connecting of the sealing portion and the capping portion is strong and stable, it prevents the shift of the sealing portion during assembling.
5. The fixed ring has an annular protrusion protruding outwardly radically, the annular protrusion is supported on the upper end face of the housing, the fixed ring has an assembly portion disposed above the annular protrusion, the surrounding portion surrounds on the outer side of the assembly portion in fixing way, the capping portion at least covers the end face at the upper end portion of the assembly portion, the assembling is convenient and fast, the connecting is strong and stable.
6. the assembly portion is concaved with an annular groove, the bottom of the surrounding portion is protruding inwardly with a protruding portion, the protruding portion is fitting to connect in the annular groove, thus being convenient to position the sealing portion and the fixed ring.
7. it has a deflecting annular wall, the water flowing clearance is disposed in the deflecting annular wall that water flows through the water flowing clearance and then directly flows to the deflecting annular wall, it can reduce the pressure loss of the water during flowing from the water flowing clearance to the diversion holes, so that it can obtain higher volume even in low water pressure and reduce the noise of the impacting of the water. The water stop ring is supported on the support seat and surrounds the central seat, when the water pressure works on the elastic water stop element, the elastic water stop element is pressed to deform inwardly radically, so that it has well water saving effect and the water volume keeps high and stable.
8. the diversion device and the annular seat can be two separate components, the structure has advantage that when to develop products with different flow volumes, it can just develop two different diversion devices, and it can adjust the arrangement and the size of the diversion holes according to different flow volumes of the diversion devices to achieve well outlet effect of the outlet devices.

BRIEF DESCRIPTION OF THE DRAWINGS

The present invention will be further described with the drawings and the embodiments.

DETAILED DESCRIPTION OF THE EMBODIMENTS

Figure 1:
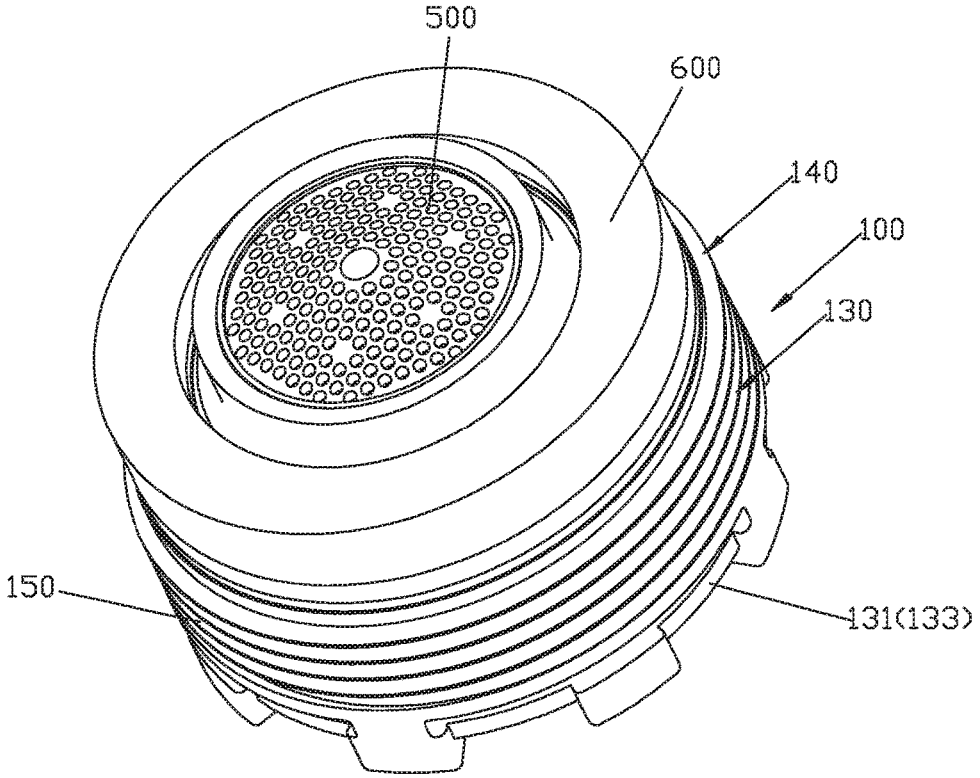
FIG. 1 illustrates a schematic diagram of the flow regulator of a preferred embodiment.
Figure 2:
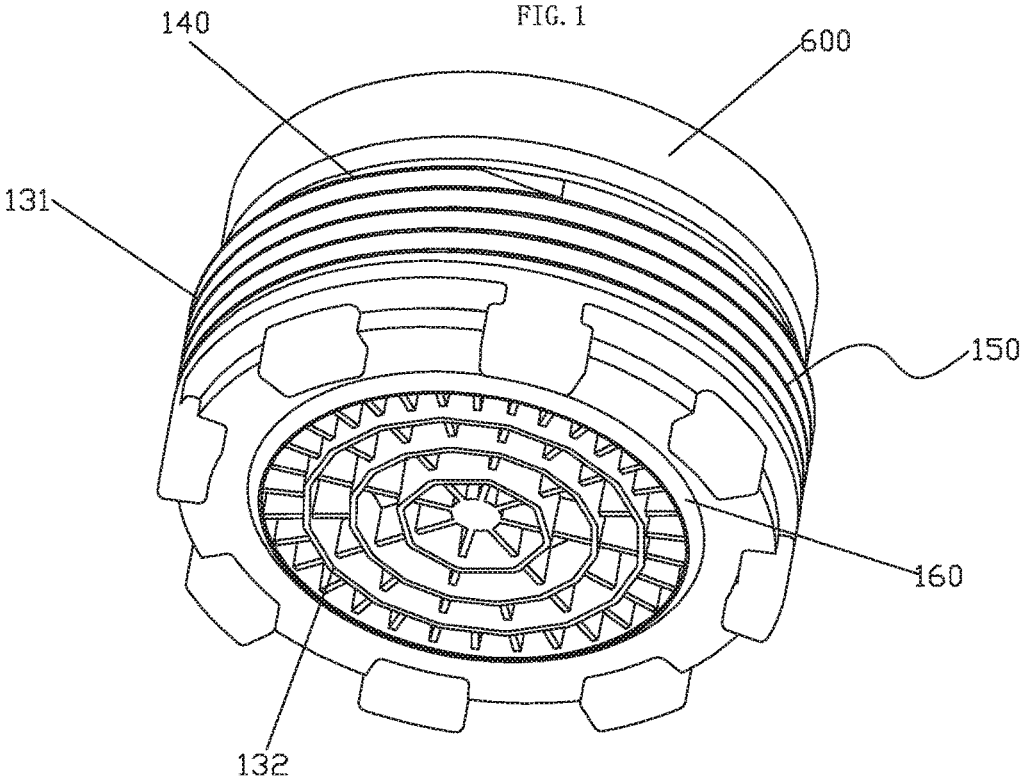
FIG. 2 illustrates a schematic diagram of the flow regulator of the preferred embodiment in another view angle.
Figure 3:
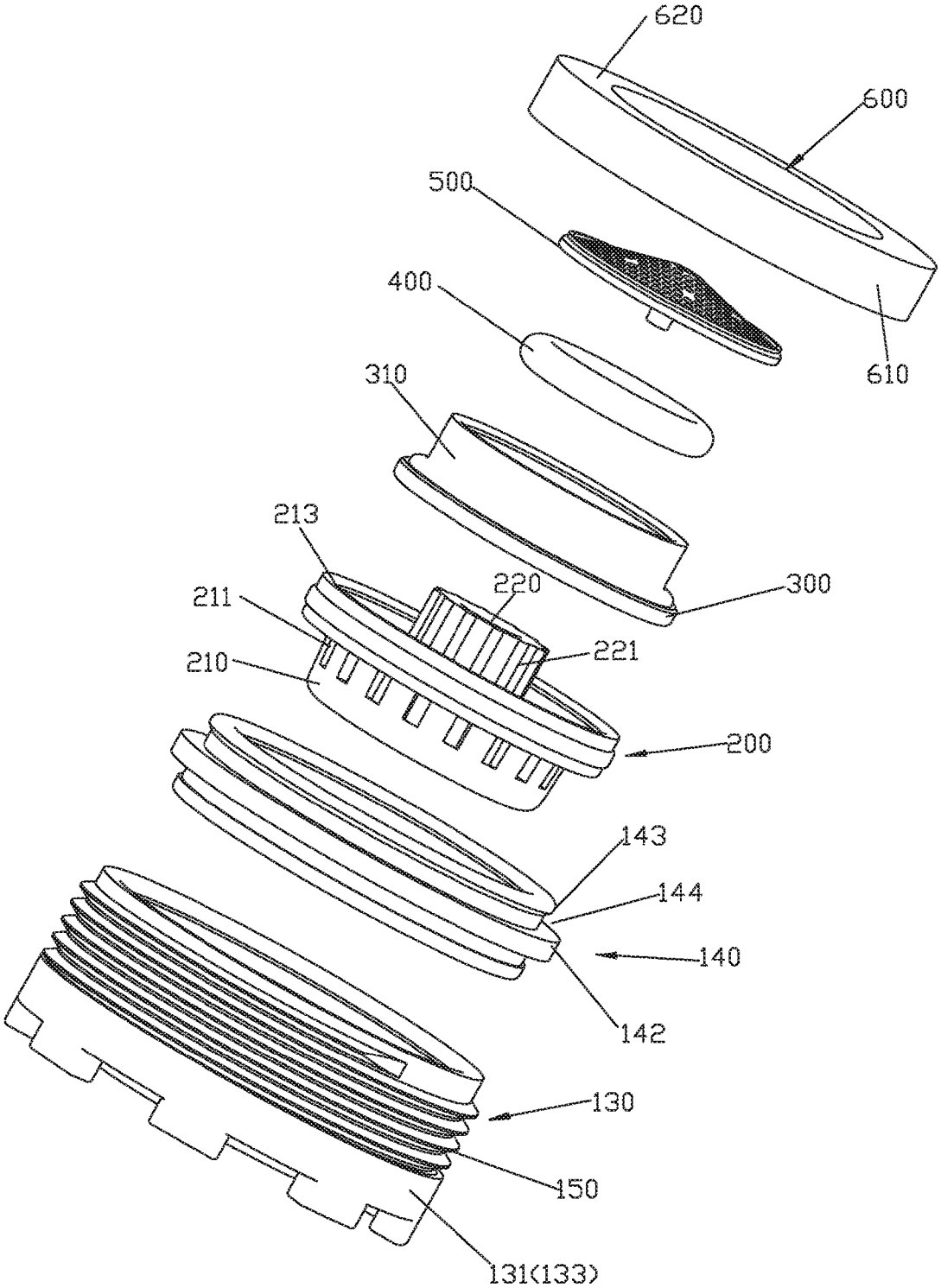
FIG. 3 illustrates an exploded and schematic diagram of the flow regulator of the preferred embodiment.
Figure 4:
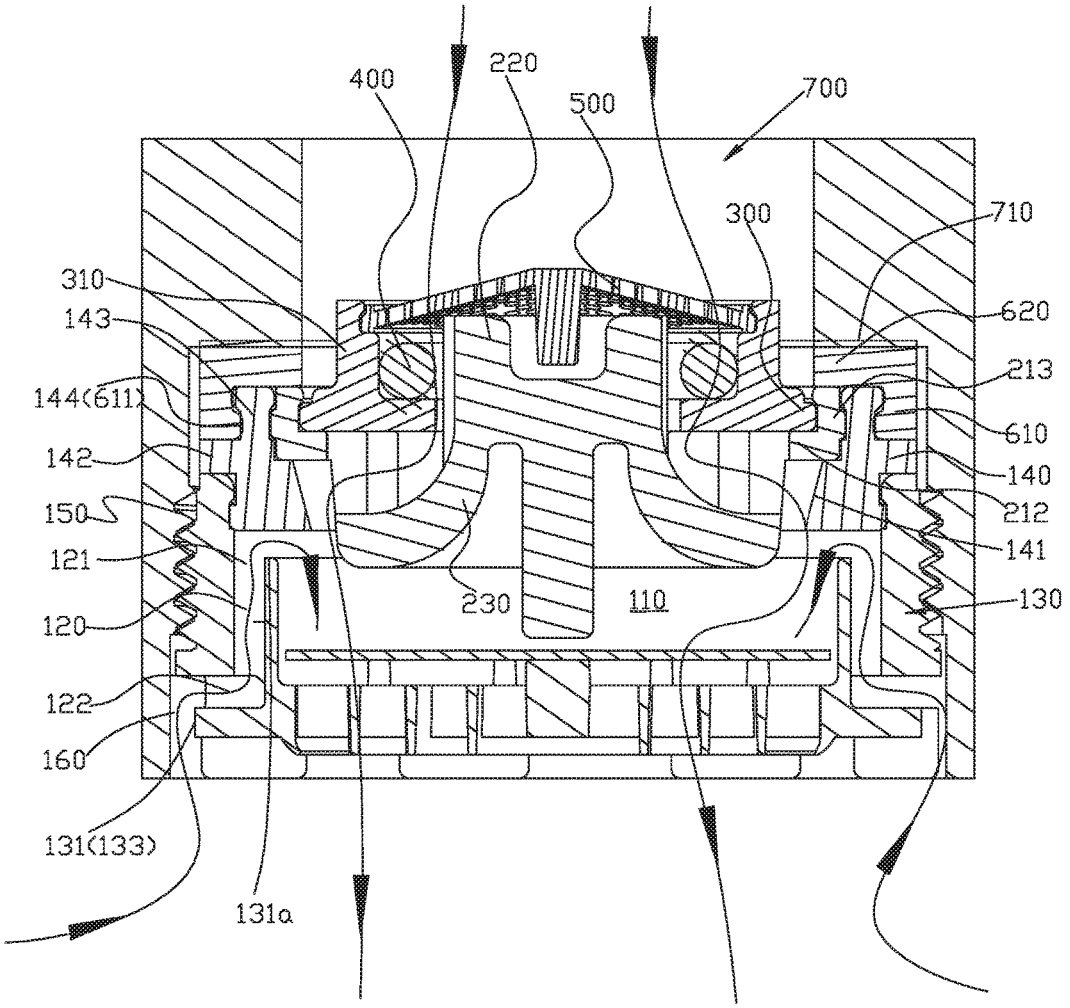
FIG. 4 illustrates a sectional diagram of the flow regulator of the preferred embodiment.
Figure 5:
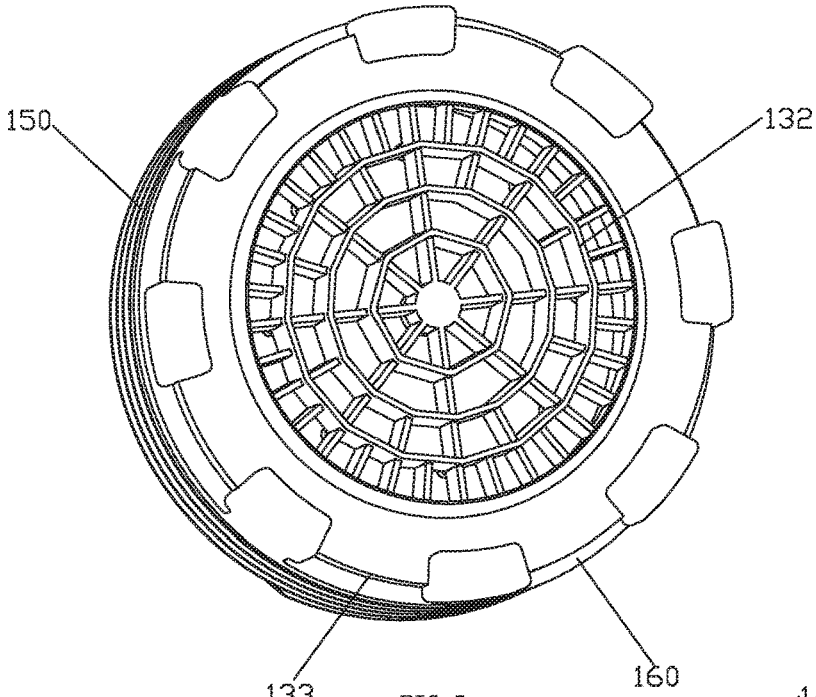
FIG. 5 illustrates a schematic diagram of the housing of the flow regulator of the preferred embodiment.
Figure 6:
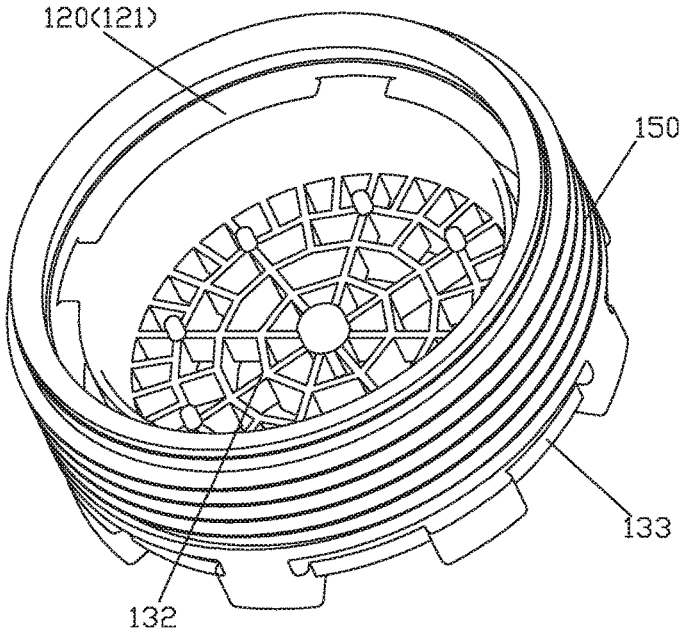
FIG. 6 illustrates a schematic diagram of the housing of the flow regulator of the preferred embodiment in another view angle.
Figure 7:
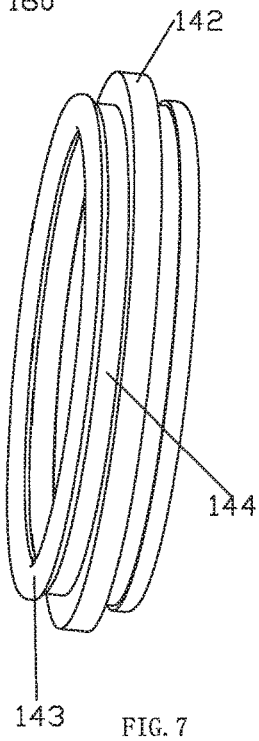
FIG. 7 illustrates a schematic diagram of the fixed ring of the flow regulator of the preferred embodiment.
Figure 8:
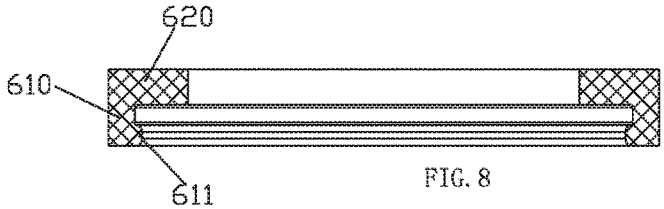
FIG. 8 illustrates a schematic diagram of the sealing portion of the flow regulator of the preferred embodiment.
Figure 9:
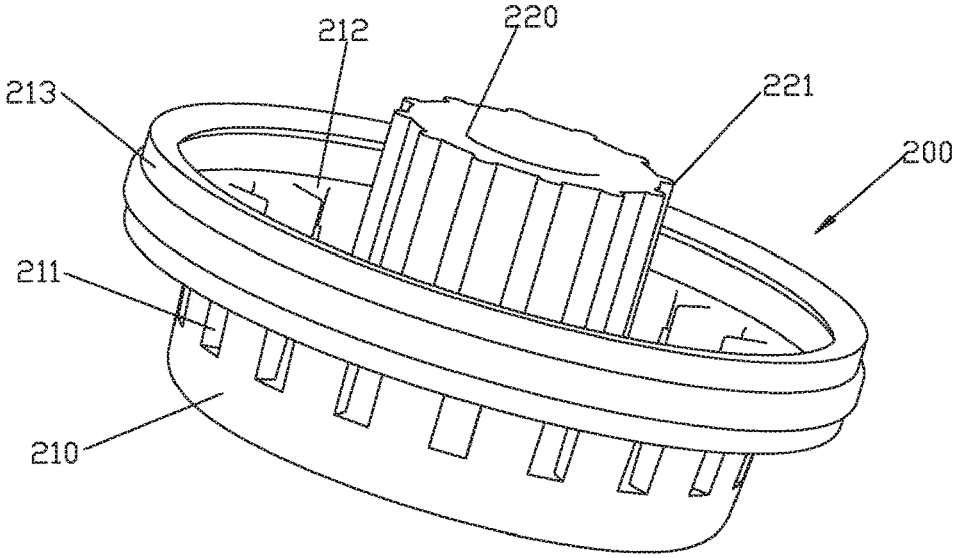
FIG. 9 illustrates a schematic diagram of the diversion device of the flow regulator of the preferred embodiment.
Figure 10:
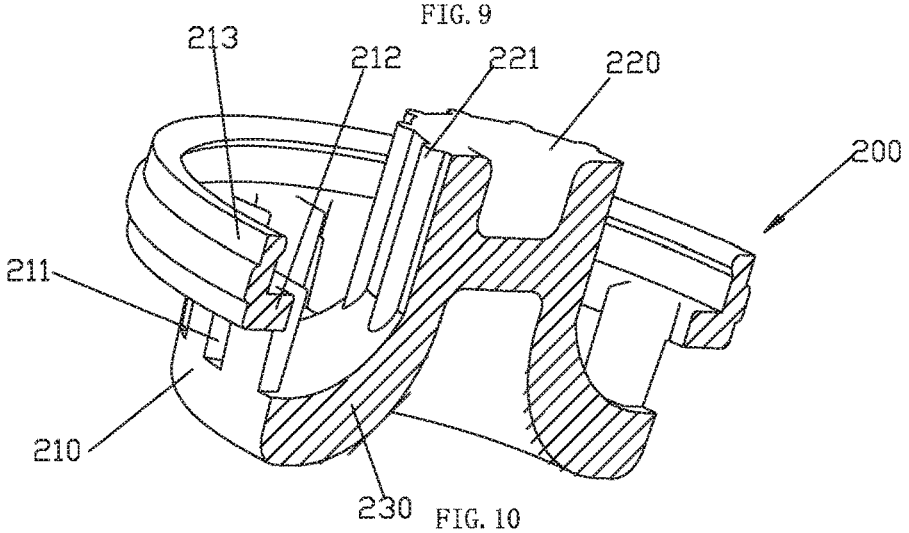
FIG. 10 illustrates a sectional and schematic diagram of the diversion device of the flow regulator of the preferred embodiment.
Figure 11:
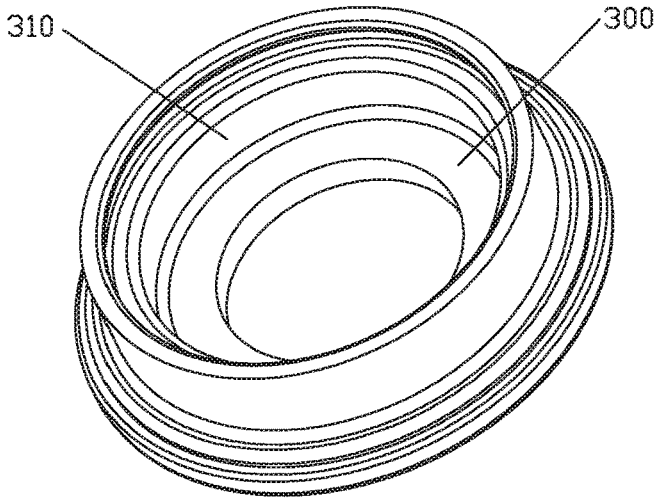
FIG. 11 illustrates a schematic diagram of the annular seat of the flow regulator of the preferred embodiment.

Please referring to FIGS. 1-11, the concealed flow regulator comprises a housing portion 100, a diversion device 200 assembled in the housing portion 100, an annular seat 300, an elastic water stop ring 400, a filter 500 and a sealing portion 600, the annular seat 300, the diversion device 200 are fixedly assembled to the housing portion 100.

The housing portion 100 comprises a housing 130 and a fixed ring 140, the housing portion 100 is configured with a mutation cavity 110.

The housing 130 comprises an outer wall 131 and an inserting element 132 fixedly connected at the bottom portion of the outer wall 131, the inserting element 132 is a grid outlet mesh. The outer wall 131 is disposed with a plurality of suction passages 120 annularly arranged running through the inside and outside of the outer wall 131. The outer wall 131 is step structural with big end down, the step structure has a step surface, the internal port 121 of the suction passage 120 is located on the step surface, so that the internal port is faced to the mutation cavity 110 and connected to the mutation cavity 110, the external port 122 of the suction passage 120 is located on the external revolution surface of the outer wall 131 of the housing 130, so that the suction passage 120 connects the inner side and the outer side of the mutation cavity 110.

The housing portion 100 is detachably assembled to the water supplying opening like the outlet of the tap, the assembly structure is that: the external revolution surface of the housing portion 100 is disposed with external thread 150, the lower portion of the external revolution surface of the housing 130 is an external smooth surface 133, which is located below the external thread 150, the external diameter of the external smooth surface is smaller than that of the external thread 150; the water supplying opening 700 has a step face 710 and an internal revolution surface extending outwardly from the external periphery of the step face, the internal revolution surface is disposed with internal thread, the lower portion of the internal revolution surface is an internal smooth surface; the external thread of the housing portion 100 is threaded to the internal thread, the internal smooth surface and the external smooth surface are arranged with annular space, which forms the air flowing clearance 160, the opening of the air flowing clearance 160 is located between the internal smooth surface and the external smooth surface and faced downwardly. Therein, the external port of the suction passage 120 is located on the external smooth surface, the air flowing clearance is connected to the external port, so that air at the outer side enters the mutation cavity 110 through the air flowing clearance, the external port and the internal port. As needed, the external smooth surface is disposed with a plurality of ribs 134 arranged peripherally with space, the ribs are fitted to contact with the internal smooth surface, the portion of two adjacent ribs forms the air flowing clearance or a portion of the air flowing clearance.

The fixed ring 140 is fixedly connected to the upper portion of the outer wall 131, the fixed ring 140 is disposed with an annular protrusion 142 protruding outwardly radically, the annular protrusion 142 is supported on the upper end face of the outer wall of the housing 130, the fixed ring 140 has an assembly portion 143 located on the annular protrusion 142. The sealing portion 600 has a surrounding portion 610 and a capping portion 620 extending inwardly from the internal periphery of the surrounding portion 610. The sealing portion 600 and the fixed ring 140 are fixedly assembled, the assembling structure is that: the surrounding portion 610 is surrounded and fixedly sleeved on the outer side of the assembly portion 143, the bottom portion of the surrounding portion 610 is supported on the annular surface of the annular protrusion 142, the surrounding portion 610 is pressed and deformed to extend out of the annular protrusion to achieve peripheral sealing, the capping portion 620 is at least capping the end face of the upper end portion of the assembly portion 143, after the flow regulator is assembled to the water supplying opening, the capping portion 620 abuts against the step surface to achieve axially sealing. Preferred, the assembly portion 143 is concaved with an annular groove 144, the bottom portion of the surrounding portion 610 is protruding inwardly with a protruding portion 611, the protruding portion 611 is fitly connected in the annular groove 144.

In this embodiment, the front end face of the fixed ring is disposed with the sealing portion, firstly, the sealing portion can fit to the tap in the end face axial sealing and the periphery face peripheral sealing so as to prevent water leakage, the end face fitting has advantage that the sealing is stable and it is easy to manufacture, it solves the problem of traditional concealed flow regulator that the side sealing face is easy to be scratched during the manufacturing of the internal thread as it is near to the internal thread of the tap that results in water leakage, at the same time, this structure makes it easier to thread than the structure sealing in the side surface; secondly, the sealing portion of the end face of the traditional flow regulator is connected to the housing in interference fitting way, it will come off during transportation, so that it needs reassemble the spacer during the assembling, it is a waste of time in assembling, the sealing of the new structure comprises the surrounding portion and the capping portion, it won't come off easily, and with the cooperation of the concave-convex, it is more strong and stable.

The diversion device 200 comprises a periphery wall 210, a central base 220 in the periphery wall 210 and a deflecting annular wall 230 fixedly connecting the periphery wall 210 and the central base 220, the upper periphery of the periphery wall 210 protrudes outwardly with a support plate 212, the external periphery of the support plate 212 protrudes upwardly to from a connecting wall 213, the periphery wall is disposed with the diversion holes 211 to divide the water flowing. The connecting wall 231 is fixedly connected to the fixed ring 140, so as to fixedly assemble the annular seat 300, the diversion device 200 to the housing portion 100. The capping portion 620 at least covers the connecting portion of the fixed ring 140 and the diversion device 200, preferred the connecting portion of the fixed ring 140 and the connecting wall 213, thus preventing water flowing out of the connecting portion directly and ensuring the water of aerating.

Water is divided from the diversion device 200 and then flows to the mutation cavity 110, the water flowing area is enlarged and negative pressure generates when the divided flowing enters the mutation cavity 110, the negative pressure sucks air in through the suction passage 120, air and water are mixed to generate bubble water. Preferred, the fixed ring 140 has a conical surface 141 corresponding to the diversion holes 211, the conical surface 141 surrounds the diversion device 200, so that water flows out of the diversion holes 211 and impacts the conical surface and then flows downwardly, the mutation cavity 110 comprises the clearance of the conical surface and the periphery wall and the portion of the housing portion below the diversion device. As needed, the periphery wall comprises a surrounding wall and an annular bottom wall extending inwardly from the periphery of the bottom of the surrounding wall radically, the diversion holes can be disposed at the surrounding wall or the annular bottom wall, the annular bottom wall is not figured out, the diversion holes are disposed at the surrounding wall, it should be noted that the diversion holes also can be disposed at the annular bottom wall.

The external periphery surface of the deflecting annular wall 230 is gradually larger downwardly radically from the central base 220 to the periphery wall 210, the central base 220 has at least a part extending out of the internal hole of the annular seat 300, a flowing clearance is formed between the central base 220 and the hole wall of the internal hole of the annular seat, the flowing clearance is disposed above the deflecting annular wall 230 to make water directly flow to the deflecting annular wall 230 through the flowing clearance. The external revolution surface of the deflecting annular wall 230 comprises a part of the conical surface. In another case, the external revolution surface of the deflecting annular wall 230 comprises a smooth curve, or in another case, the external revolution surface of the deflecting annular wall 230 comprises an arc with the center of circle outward.

The annular seat 300 is fixedly assembled to the periphery wall 210, the assembling structure is that the annular seat 300 is supported on the support plate 212, the connecting wall 213 and the annular seat 300 are coupled to make the annular seat 300 and the diversion device 200 fixedly connected together. The annular seat 300 is protruding upwardly with a protruding wall surrounding the internal hole of the annular seat 300, the water stop ring 400 is supported on annular seat 300, the external side of the water stop ring 400 is contacted with the internal side of the protruding wall 310, the water stop ring 400 surrounds the central base 220 in fitting way, so that water flowing area of the water flowing clearance can be adjusted by the water pressure. Preferred, the portion of the central base 220 corresponding to the water stop ring 400 is annularly arranged with a plurality of protrusions 221 with space. When in low pressure, the elastic water stop ring is pressed with low force, it just slightly deforms, at this time the flowing area of the elastic water stop ring and the protrusions 221 of the central base 220 of the diversion device is larger, the flow volume can be controlled in a certain value; when in high pressure, the elastic water stop ring is pressed with high force and it deforms greater, at this time, the water stop ring and the protrusions 221 of the central base 220 of the diversion device are cooperated to each other, so that the flowing area is reduced during the increasing of the pressure, the flow volume can be controlled in a certain value; so the flow regulator has volume adjusting function, it can regulate the volume in a certain range of pressure.

The filter 500 is assembled to the protruding wall 310.

In this embodiment, the diversion device and the annular seat are manufactured separately and they can be fixedly assembled together, in other case, they can be manufacturing integrately as needed, if they are separately manufactured, it can just change the diversion device to develop flow regulators with different flow volume. The structure has advantages, it can configure diversion holes with different sizes according to different flow volume classes to achieve best spraying outlet effect. Water flows out of the diversion holes of the diversion device and impacts the conical surface of the fixed ring to be rectified and finally flows out of the outlet of the housing, the effect is that the outlet volume is more stable, and it is water saving, the water is more soft.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A concealed flow regulator for attaching to a water supply opening that provides a water flow and that is disposed with threads, the concealed flow regulator comprising:

a housing portion that is connected to the water supply opening and forms an air flow clearance in communication with an inner wall of the water supply opening that communicates with exterior air, that has an external revolution surface disposed with external threads for connection to the threads of the water supply opening, and in which is defined a mutation cavity and a suction passage in communication with the mutation cavity, the suction passage having an external port disposed in the external revolution surface of the housing portion in communication with the air flow clearance and an internal port that connects an interior portion of the mutation cavity with the exterior air;

a water diversion device that is assembled within the housing portion, that comprises a central base; a deflecting annular wall extending from the central base; and a periphery wall extending from the deflecting annular wall and being provided with diversion holes, that divides the water flow, and through which the water flow flows into the mutation cavity and generates a negative pressure which sucks in exterior air via the air flow clearance and the suction passage that mixes with the divided water flow to produce bubble water:

an annular seat having an internal hole having a hole wall; and an elastic water stop ring supported on the annular seat, wherein the annular seat, the water diversion device and the housing portion are assembled together, wherein the water diversion device further comprises:

the central base disposed within the periphery wall and having at least a part that extends out of the internal hole of the annular seat; and the deflecting annular wall fixedly connecting the periphery wall and the central base and having an external peripheral surface that becomes gradually radially larger downwardly from the central base to the periphery wall, wherein a water flow clearance is formed between the central base and the hole wall of the internal hole of the annular seat, the water flow clearance is disposed above the deflecting annular wall to make water directly flow to the deflecting annular wall through the water flow clearance, and wherein the elastic water stop ring surrounds and fits to the central base so that a flowing area of the water flow clearance is adjusted by water pressure so as to save water.

2. The concealed flow regulator according to claim 1, wherein the external revolution surface of the housing portion comprises an external surface that is smooth and that is provided below the external threads and that has a diameter that is smaller than that of the external thread, wherein the external port of the suction passage is located on the external smooth surface, and wherein the external smooth surface of the external revolution surface and the inner wall of the water supply opening are annularly arranged and define an annular space therebetween, which annular space forms the air flowing clearance.

3. The concealed flow regulator according to claim 2, wherein the water supply opening is disposed with a step face and an internal revolution surface extending outwardly from an external periphery of the step face, wherein the internal revolution surface is disposed with internal threads and a lower portion of the internal revolution surface has an internal surface that is smooth, wherein the external threads of the housing portion are threaded to the internal threads of the internal revolution surface, and wherein the internal surface of the lower portion of the internal revolution surface and the external surface of the external revolution surface of the housing portion are arranged with a space therebetween.

4. The concealed flow regulator according to claim 1, wherein the housing portion comprises a housing having an outer wall; and a fixed ring that is fixedly connected to an upper portion of the outer wall, and wherein the outer wall has a step structure having a wider end at a lower portion of the outer wall and having a step surface on which is located the internal port of the suction passage.

5. The concealed flow regulator according to claim 1, wherein the flow regulator further comprises a sealing portion having a surrounding portion and a capping portion extending inwardly from an internal periphery of the surrounding portion, wherein the housing portion comprises a housing having an outer wall; and a fixed ring that is fixedly connected to an upper portion of the outer wall, that is disposed with an annular protrusion that outwardly radially protrudes and is supported on an upper end face of the housing, and that has an assembly portion located on the annular protrusion, and wherein the surrounding portion is surrounded by and fixedly sleeved on an outer side of the assembly portion, and the capping portion at least caps an end face of an upper end portion of the assembly portion.

6. The concealed flow regulator according to claim 5, wherein the assembly portion has a concaved shape and has defined therein an annular groove, and a bottom portion of the surrounding portion has a protruding portion that protrudes inwardly and that is fixedly connected within the annular groove.

7. The concealed flow regulator according to claim 6, wherein the bottom portion of the surrounding portion is supported on an annular surface of the annular protrusion, and the surrounding portion is pressed and deformed to extend out of the annular protrusion so as to achieve peripheral sealing.

8. The concealed flow regulator according to claim 1, wherein the annular seat is fixedly connected to the periphery wall and has a protruding wall disposed to protrude from the annular seat to surround the internal hole of the annular seat, and wherein the elastic water stop ring has an external side that contacts an internal side of the protruding wall.

9. The concealed flow regulator according to claim 8, further comprising a filter that is assembled to the protruding wall.

10. The concealed flow regulator according to claim 8, wherein the periphery wall has an upper periphery that protrudes outwardly to form a support plate having an external periphery that protrudes upwardly to form a connecting wall, and wherein the annular seat is supported on the support plate and is fixedly connected to the water diversion device by cooperation of the connecting wall and the annular seat.

11. The concealed flow regulator according to claim 8, wherein the housing portion comprises a housing having an outer wall; and a fixed ring that is fixedly connected to an upper portion of the outer wall, and wherein the fixed ring has an internal surface that is a conical surface and corresponds to the diversion holes, and wherein the conical surface surrounds the water diversion device so that water flows out of the diversion holes and impacts the conical surface of the fixed ring.

12. The concealed flow regulator according to claim 1, wherein the deflecting annular wall has an external revolution surface that includes a conical surface.

13. The concealed flow regulator according to claim 1, wherein the deflecting annular wall has an external revolution surface that includes a smooth curve.

14. The concealed flow regulator according to claim 1, wherein the deflecting annular wall has an external revolution surface that includes an arc whose projected center point faces outwardly.

* * * * *